United States Patent [19]

Surti

[11] Patent Number: 4,790,675

[45] **Date of Patent: * Dec. 13, 1988**

[54] UNIVERSAL RIBBON CARTRIDGE

[76] Inventor: Tyrone N. Surti, 424 Harding Industrial Dr., Nashville, Tenn. 37211

[ * ] Notice: The portion of the term of this patent subsequent to Dec. 16, 2003 has been disclaimed.

[21] Appl. No.: 59,598

[22] Filed: Jun. 8, 1987

Related U.S. Application Data

[63] Continuation-in-part of Ser. No. 855,072, Apr. 22, 1986, which is a continuation-in-part of Ser. No. 725,931, Apr. 22, 1985, Pat. No. 4,629,346.

[51] Int. Cl.[4] ..... B41J 32/00

[52] U.S. Cl. ..... 400/208; 400/223; 400/243

[58] Field of Search ..... 400/207, 208, 208.1, 400/243, 223, 235, 236; 242/192, 200

[56] References Cited

U.S. PATENT DOCUMENTS

| | | | |
|---|---|---|---|
| 4,400,103 | 8/1983 | Daughters | 400/243 X |
| 4,496,255 | 1/1985 | Meintrup et al. | 400/208 |
| 4,629,346 | 12/1986 | Surti | 400/208 |

FOREIGN PATENT DOCUMENTS

| | | | |
|---|---|---|---|
| 162682 | 12/1981 | Japan | 400/236 |

*Primary Examiner*—Charles Pearson
*Attorney, Agent, or Firm*—C. A. Phillips

[57] ABSTRACT

A printer ribbon cartridge of the type employing two ribbon spools mounted in spaced relation in the cavity formed in the case of the cartridge. The ribbon is driven by a belt engaging the spools. The belt is rotated over the spools by rotation of a predetermined drive wheel of two spaced sets of two intermeshing drive wheels. Means are provided for operating the cartridge in various printers having drive locations of varying spatial location as well as direction of rotation.

4 Claims, 4 Drawing Sheets

(PRINTER 2)

(PRINTER 4)

(PRINTER 1)

(PRINTER 3)

(PRINTER 6)

(PRINTER 8)

(PRINTER 5)

(PRINTER 7)

UNIVERSAL RIBBON CARTRIDGE

CROSS-REFERENCE OF RELATED APPLICATION

This invention is a continuation-in-part of application Ser. No. 06/855,072, filed Apr. 22, 1986, entitled "Ribbon Cartridge," which is a continuation-in-part of application Ser. No. 06/725,931, filed Apr. 22, 1985, entitled "Printer Ribbon Cassette," now U.S. Pat. No. 4,629,346, issued Dec. 16, 1986.

TECHNICAL FIELD

This invention relates generally to printing ribbon holders and particularly to spool-type ribbon cartridges having separate, and spaced, drive means adjacent each side edge of the cartridge and means for driving a cartridge drive wheel from the drive wheels of different printers having different drive locations and directions. The drive mechanism also permits the cartridge to be turned over for operation from either the top or bottom surfaces.

BACKGROUND OF THE INVENTION

Printers for printing out the outputs of computers are understandably varied in configuration. Two very popular groups, exemplified by NEC Models 2000/3500/8000 and Diablo HyType II, are of the daisy wheel type, printing a whole character with each stroke of printer operation. These printers employ a ribbon cartridge wherein a ribbon wound on and between two spools is impacted by a character print element of the printer. Cartridge configurations for these printers are illustrated by U.S. Pat. Nos. 4,496,255, to Meintrup et al, 4,533,266 and to Shapiro; and 4,544,291 to Kano. A principal characteristic of such cartridges is that they employ two laterally spaced capstan drives, alternately driven through opposite sides of the cartridge by a rotary drive member of a host printer. One of the capstan drives rotates a ribbon in one direction, wherein a top region of the ribbon is utilized in printing, and the other capstan drive rotates the ribbon in the opposite direction and a bottom region of the ribbon is utilized. Each of the capstan drives consists of a drive roller and a pinch roller, and each capstan drive is associated with one of two spools of the cartridge. A belt is coupled between the driven roller and its associated spool, driving this spool, as a take-up spool, in a direction to receive the ribbon. This belt is positioned on the outside of the cartridge, connecting between pulleys on shafts of the drive roller and spool. In order to switch directions of drive, the cartridge is turned over and the belt is removed from pulleys on one side of the cartridge and placed around pulleys on the opposite side.

A still further disadvantage is that the cartridges are for use in only a single type of printer because the position and direction of rotation of the output drive shaft of the printer is fixed as is the position of the holding mechanism for securing the cartridge in the printer. Thus, to be capable of being used in other types of printers, the cartridge must be capable of receiving printer drive shafts which may rotate in a different direction and from varying locations, while being held in the printer by different types of holding devices. None of these references provide such a capability.

The belt and pulley arrangement discussed is an obvious disadvantage, both from the point of view of inconvenience and the variable tension effected upon the take-up spool as the amount of ribbon on it changes. Perhaps in recognition of the most blatant of these, the inconvenience, Meintrup suggests that an internal belt might be employed and cites a data tape cartridge manufactured by the 3M Company as providing such. This cartridge or cassette is illustrated in Von Behren U.S. Pat. No. 3,692,255, and a ribbon cartridge counterpart of it is illustrated in Sasaki U.S. Pat. No. 4,528,572. Upon examination of these references, it appears that both employ a single, centrally positioned drive member and thus are employable only with drive units, tape drives or printer drives, adapted to interface with a central position on a cartridge and not one where separate, spaced capstan drives are employed as required by the printers referred to above. Clearly, neither of these patents provide a teaching as to how one would employ an internal belt in a ribbon cartridge where the drive positions are spaced apart as in the class of cartridge we are concerned with here. In contrast, the inapplicability is manifest and is obvious from the fact that if a belt were stretched between the capstan drives of Meintrup, with an idler symmetrically positioned, e.g., where the drive roller is positioned in the case of Sasaki, the ribbon would be driven by the belt in one direction and the ribbon spool in an opposite direction, an inoperative condition.

The patent to Daughters, U.S. Pat. No. 4,307,969, provides a cartridge for use in two different printing machines having drive locations of varying spatial locations as well as direction of rotation. While the Daughters patent is entitled "Universal Ribbon Cartridge," it is only universal to the extent that it can be used in two printers. The first printer must have its drive shaft located to the left and rotatable in a counterclockwise direction, while the drive shaft of the second printer must be placed in a position which is generally adjacent to and slightly inwardly of the drive shaft of the first printer, and the drive shaft must rotate in a counterclockwise direction. No provision is made in the patent to Daughters for driving the tape from different drive shaft locations and rotations from the other (right side) of the cartridge. Additionally, the patent to Daughters is driven by an external belt and, therefore, has the same disadvantage as discussed above in conjunction with the variable tension effected upon the take-up spool as the amount of ribbon on it changes. Further, the cartridge to Daughters permits only one pass of the ribbon through the impact region of the printer. It does not provide for the cartridge to be turned over so that the unused portion (upper or bottom half) of the ribbon may be used in a second pass of the ribbon through the printer.

A still further matter of concern with respect to the merit of ribbon cartridges is that of rate of use of ribbon. Ideally, the ink in the vicinity of an impact by a printing element will be completely utilized but not to the extent that a portion of a character being printed will receive insufficient ink. Pertinently, the rate of ribbon usage is a function of the speed of the rotating drive of the printer and the translation of this speed to a final ribbon drive speed, the latter being a function of the drive mechanism of the cartridge. Since the drive speed is thus fixed by a printer manufacturer, it is up to the ribbon cartridge manufacturer to provide a cartridge which will provide an optimum rate of ribbon advancement for the drive speed at hand. Unfortunately, it appears that because of certain structural limitations imposed by the mechanisms employed in prior art ribbon cartridges, they effect a higher rate of ribbon travel than is actually necessary to provide good print quality. Specifically, it appears that this is the result of employing a direct capstan drive of ribbon, which in turn has necessitated the employment of toothed surfaces to obtain sufficient grip on a ribbon to reliably advance it. This in turn has resulted in an excessive effective diameter of the drive roller, resulting in an excessive effective rate of ribbon advancement.

SUMMARY OF THE INVENTION

In accordance with this invention, alternately, any one of two drive wheels of a set of two spaced sets of drive wheels, driven by a printer, drives a belt internally located in a ribbon cartridge, and this belt engages the ribbon at two locations where it is wound on the spools, it further engages an idler roller, and it engages the other (then undriven) drive wheel of the other set. The ribbon is not engaged by a drive wheel either directly or through the thickness of the belt. The idler roller is positioned to hold the belt against the ribbon where it is wound on ribbon spools. The wheel which is driven by the drive shaft of the printer moves the belt (either directly or through its adjacent mating wheel of the set) across a wheel of the second set of drive wheels, then over the ribbon on one spool, around the idler roller, over the ribbon on the other spool, and back over the wheel of the driving set of rollers. The ribbon path takes it from one spool, through an impact region and onto the second spool. Optimum ribbon tension is maintained on the ribbon throughout its movement. A predetermined drive wheel of the two drive wheels of each set of wheels may be driven by the drive shaft of the printer. Additionally, the sets of drive wheels are positioned in a manner which permits the cartridge to be turned over so that a wheel of the other set engages the drive shaft of the printer so that the ribbon may pass through the impact region of the printer for a second time to permit the unused portion (upper or lower half of the ribbon) to be used.

Figure 4:
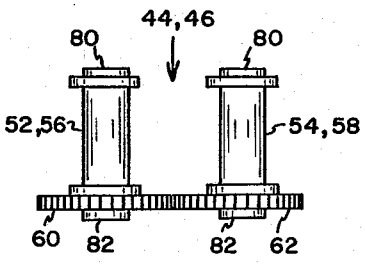
FIG. 4 is an enlarged elevational view of adjacent drive gears comprising one set of drive gears of the cartridge of the present invention.
Figure 3:
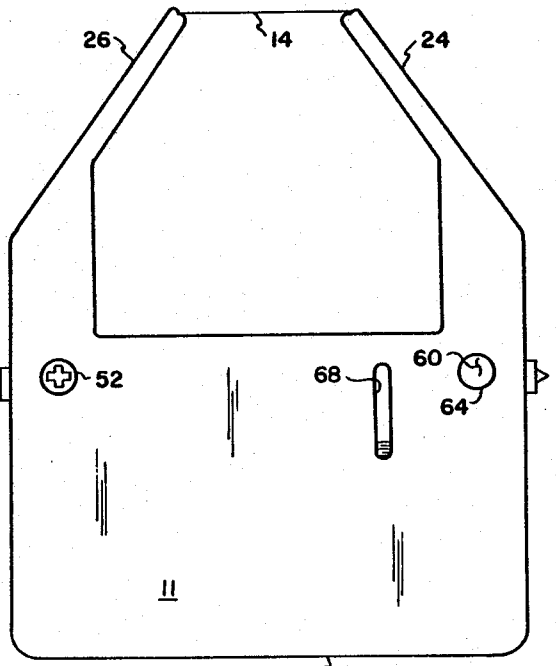
FIG. 3 is a bottom plan view of the cassette shown in FIG. 1.
Figure 2:
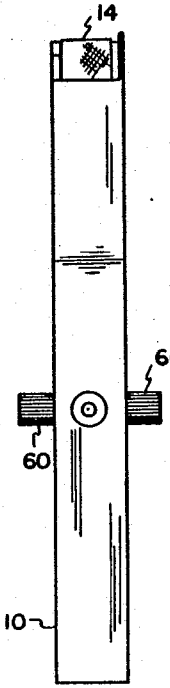
FIG. 2 is a side view of the cassette of FIG. 1.

FIGS. *6a–6h* are diagrammatic views illustrating the various combinations of locations and directions of rotation that the drive wheels of the ribbon cartridge of the present invention may assume in being used in different printers.

DETAILED DESCRIPTION OF THE DRAWINGS

Referring to the drawings, a ribbon case 10 houses in cavity 12 transport and storage means for a printing ribbon 14. Ribbon 14 is stored on and winds between spools 16 and 18 and is guided in a path which ultimately places it between ribbon guides 20 and 22. Guide 20 is supported on the front side of case 10 by arm 24, and guide 22 is supported on the front side of the case by oppositely supported arm 26. A print head from a host printer (not shown) effects printing on, for example, paper by a print character being impacted through a generally central region of ribbon 14 between guides 20 and 22.

Ribbon spools 16 and 18 are conventionally supported by stub axles 28 and 30 extending from broad side 11 of case 10.

Ridge members 32, 34, 36, and 38 form spaced supports to provide stability for the assembled cartridge. When in place, cover 40 is attached via pins (not shown) which extend into openings 42 spaced about the cartridge.

The ribbon transport means includes two sets of drive wheels 44 and 46 mounted in the cavity generally in the regions of cartridge sides 48 and 50, respectively. Projections 51 and 53 are provided on sides 48 and 50 to secure the cartridge in the printer. Wheel set 44 includes wheels 52 and 54, and set 46 includes wheels 56 and 58. Each wheel set is identical, and the wheels of each set include teeth 60 and 62 for meshed engagement, whereby rotation of one wheel produces rotation of the adjacent wheel in the opposite direction.

Belt 64 (see dotted lines) interconnects a drive wheel of each set 44 and 46 (in this case, wheels 54 and 56, even though other pairs of wheels may be resorted to, if desired) and effects a positive drive between the drive wheel being driven by the printer and ribbon 14. Belt 64 is held in tension by an idler roller 66, the latter being positioned to provide a belt path which holds belt 64 against ribbon 14 where it is wound on spools 16 and 18.

Idler roller 66 is generally positioned toward a rear side of case 10 along a line bisecting case 10 between the axis of spools 16 and 18, this line being generally normal to the linear portion of travel of belt 64. While idler roller 66 is fixedly mounted as shown, it may be spring loaded to permit travel to a selected ribbon region, for example, along the locational line just referred to. In this case, bolt 64 may be essentially nonstretchable and tension described above would be provided by the spring biasing of idler roller 66. Openings 68 provide a view of the state of ribbon on one of the spools, there being an opening 68 in each of the two sides of case 10 such that one spool is observable from one side and the other from the other side.

Figure 1:
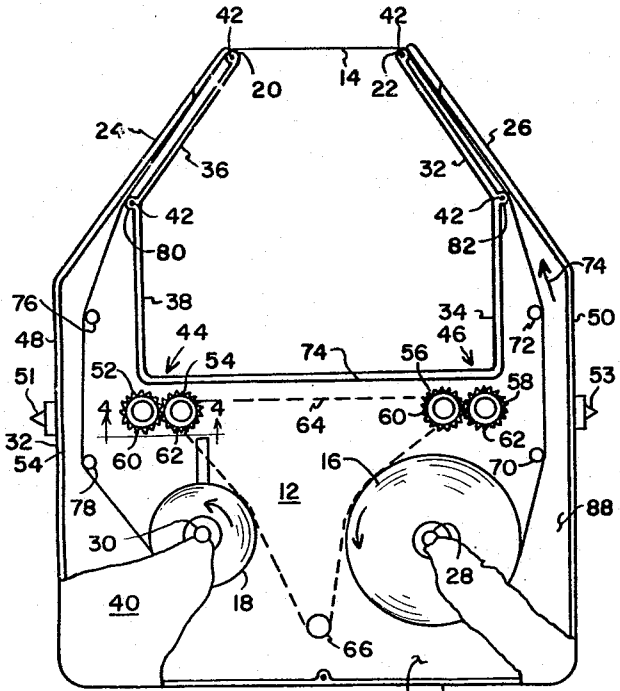
FIG. 1 is a top plan view, partially broken away, of an embodiment of a ribbon cassette constructed in accordance with the present invention.

Drive of belt 64 is effected by the particular drive wheel 52, 54, 56, or 58 in engagement with the host printer. Assume that it is drive wheel 52, which is shown in FIG. 1 as being driven in the direction of the arrow (counterclockwise). As drive wheel 52 is rotated, it transmits (through teeth 60 and 62) clockwise rotation to wheel 54 which cause clockwise rotation of belt 64, which passes around wheel 56 and over the generally top side of the ribbon on spool 16, then moving on and around idler 66, then over the ribbon on spool 18 and back to drive roller 54. In terms of FIG. 1, cartridge 10 would lie generally horizontal and one would be looking down on the cartridge, and the underside (not shown) of drive roller 52 would be engaged with the printer, which imparts a driving movement to wheel 54, which drives the belt.

With drive occurring as described in the foregoing paragraph, ribbon 14 would be passing off of the generally rear side of spool 16, then outwardly toward side 50 and around a guide 70, thence outward of drive roller 58 to a guide 72, guides 70 and 72 assuring that ribbon 14 does not engage or rub on belt 64. Ribbon 14 then passes, as shown by arrow 74, over and between guides 20 and 22. Then it passes over a pair of guides 76 and 78 on the opposite side 51 of cartridge 10 and thence onto spool 18.

Once the tape has been completely unwound from spool 16 and wound on spool 18, the cartridge is then turned over, and with cartridge 10 turned over, drive roller 58 would be in engagement with the drive shaft of the printer to drive the belt. Belt 64 would then move in the reverse direction as would ribbon 14.

If the drive shaft of the printer is displaced slightly inwardly from that of the above-described printer and is rotating in a clockwise direction, then the cartridge is positioned in the printer so that drive wheel 54 is directly driven by the printer's drive shaft, and clockwise rotation is imparted to belt 64 which rotates around wheel 56 and over the supply ribbon on spool 16, around idler 66, and over the ribbon which may be on spool 18 and back around drive wheel 54. This rotation of belt 64 transmits counterclockwise rotation to spool 16 and to spool 18 to unwind the ribbon from spool 16 for travel through the impact region between guides 22 and 20 and onto spool 18, in the manner described above.

Again, after the tape has been completely unwound from spool 16 and wound on spool 18, the cartridge is then turned over; and with cartridge 10 turned over, drive roller 56 would be in engagement with the drive shaft of the printer for clockwise rotation thereby to drive belt 64 and ribbon 14 in the reverse direction. The belt then is moved over the ribbon on spool 16, around idler roller 66, over spool 18, and back around drive wheel 56. The ribbon would be unwound from spool 18 and onto spool 16.

Figure 6B:
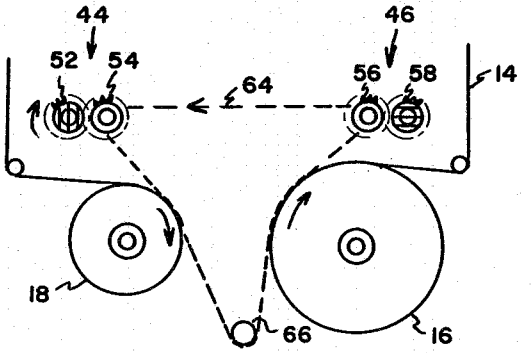
Figure 6D:
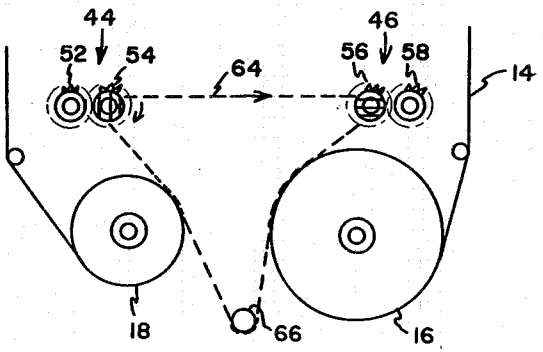
Figure 6A:
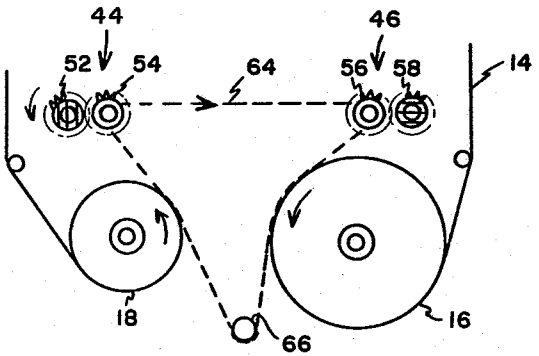

FIGS. 6*a*–6*h* are diagrammatic views illustrating the various combinations of location and directions of rotation that the drive wheels of the ribbon cartridge of the present invention may assume in being used in different printers. For example, FIG. 6*a* illustrates that the drive wheel 52 (shaded in vertical lines) of set 44 is in engagement with a printer (designated as printer 1) which is provided with a drive shaft which rotates in a counterclockwise direction. This is the same as illustrated in FIG. 1. The horizontal shade lines on roller 58 illustrate that roller 58 engages the printer drive shaft when the cartridge is turned over.

FIG. 6*b* illustrates that the vertically shaded drive wheel 52 of set 44 is in engagement with a printer (designated as printer 2) having a drive shaft which is in the same location as that illustrated in FIG. 6*a*, however, with the drive shaft rotating in a clockwise direction. Wheel 58 is horizontally shaded to illustrate that this is the wheel which engages the drive shaft of the printer when the cartridge is turned over to print on the unused portion of tape.

Figure 6C:
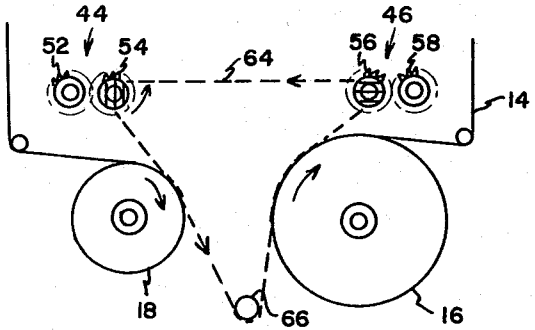

FIG. 6*c* illustrates that the shaded drive wheel 54 (vertical lines) is in engagement with a printer designated as printer 3 in which the drive shaft thereof is displaced slightly inwardly of that described in conjunction with FIGS. 6*a* and 6*b* and which rotates counterclockwise. The horizontal shade lines of roller 56 illustrate that this is the roller which engages the drive shaft of the printer when the cartridge is turned over.

FIG. 6*d* illustrates that the same drive wheel 54 as shown in FIG. 6*c* is in engagement with the drive shaft of a printer (designated as printer 4) which is provided with a drive shaft which rotates clockwise. Vertical shade lines are provided on drive wheel 54 to illustrate that this is the wheel which is to be driven, and horizontal shade lines are provided on wheel 56 which illustrate that wheel 56 is the wheel which engages the printer when the cartridge is turned over.

Figure 6F:
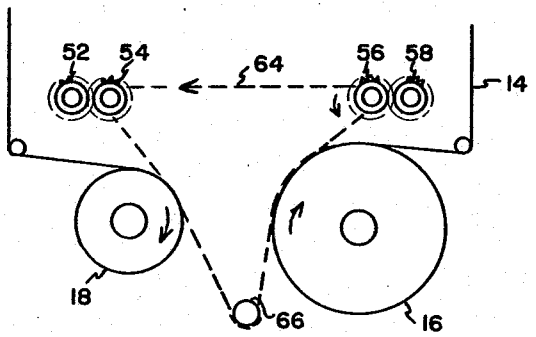
Figure 6H:
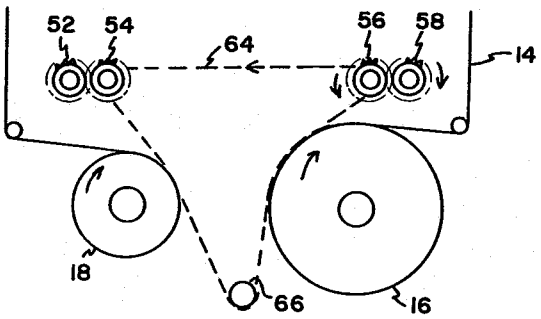
Figure 6E:
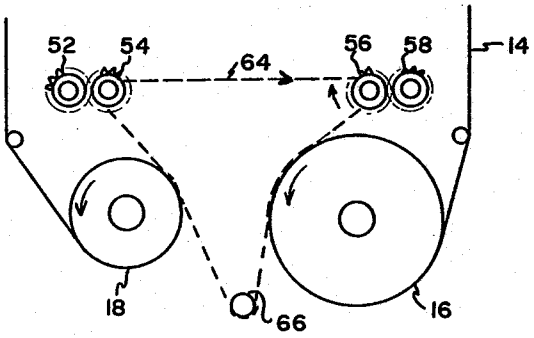

FIGS. 6*e* and 6*f* are similar to those described in conjunction with FIGS. 6*a*–6*d*. However, the cartridge is shown to be operated by printers designated 5–8, respectively, with drive occurring on the opposite (right) side. Vertical shade lines are used to indicate the wheel driven by the printer, while horizontal shade lines are used to indicate the wheel which is engaged by the printer when the cartridge is turned over.

In FIG. 6*e*, for example, wheel 56 is directly driven in a clockwise direction by a printer designated as printer 5 to move the belt in a clockwise direction. This rotates ribbon spools 16 and 18 counterclockwise. In FIG. 6*f*, wheel 56 is directly driven by a printer designated as printer 6 in a counterclockwise direction to rotate the belt in a counterclockwise direction which rotates spools 16 and 18 in a clockwise direction. Wheel 54 is engaged by the printer when the cartridge is turned over.

Figure 6G:
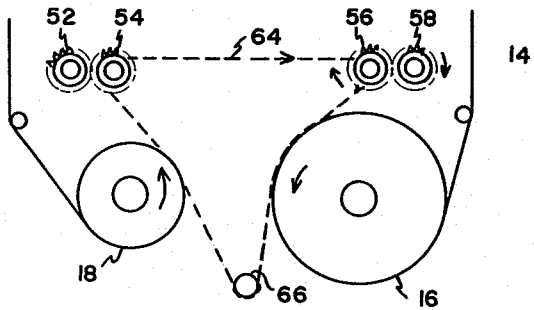

In FIG. 6*g*, wheel 58 is rotated by the printer, designated as printer 7, in a counterclockwise direction, which rotates wheel 56 clockwise to rotate the belt in a clockwise direction. Spools 16 and 18 are rotated in a counterclockwise direction. Wheel 54 is engaged by the printer when the cartridge is turned over. In FIG. 6*h*, wheel 58 is rotated clockwise to rotate wheel 56 counterclockwise which rotates the belt in a counterclockwise direction for clockwise rotation of spools 16 and 18. The printer is designated as printer 8. Wheel 52 is engaged by the printer when the cartridge is turned over.

In any event, the shafts of each wheel are designed to be engaged by the printer output shaft from both ends, and the ribbon is of sufficient width (approximately ½") so as to permit both, the upper and lower, halves to be used. Thus, after the ribbon has been passed through the impact region one time, the operator merely turns the cartridge over so the other half of the ribbon may be used.

Figure 5:
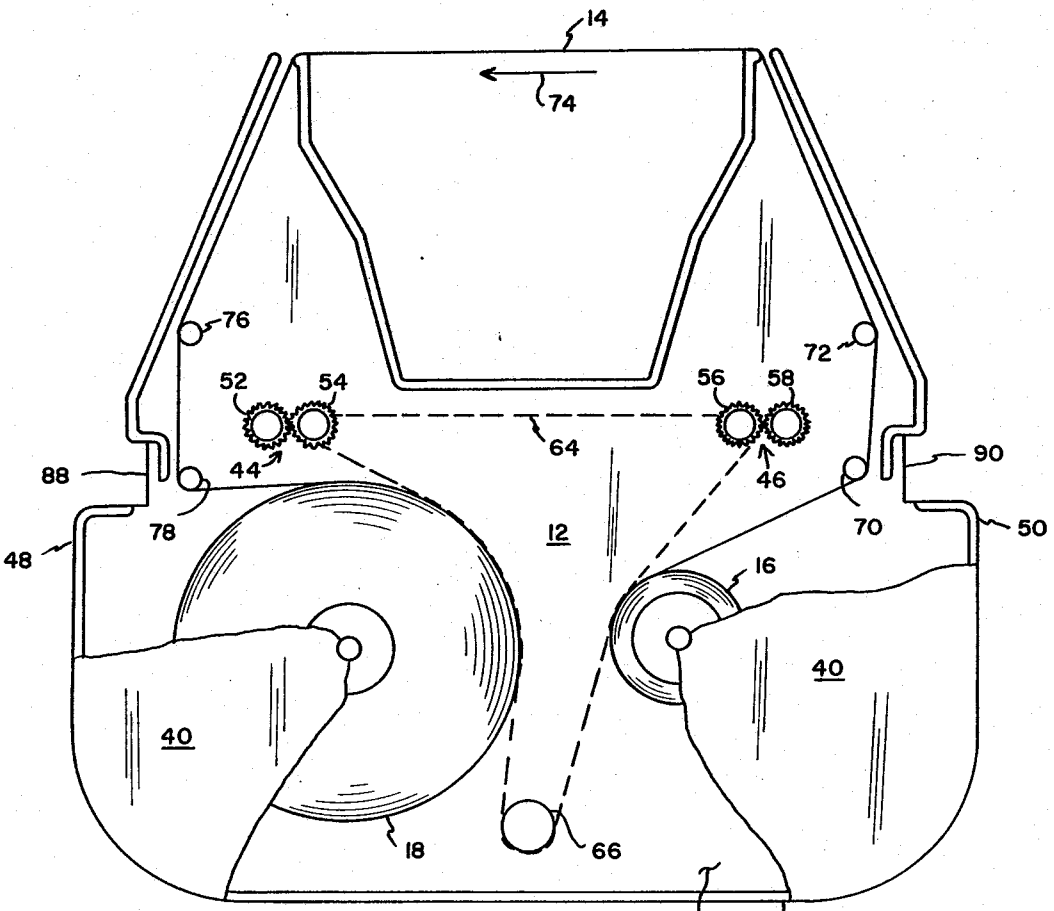
FIG. 5 is a plan view similar to FIG. 1 illustrating the drive mechanism of the present invention in use in a cartridge of a different configuration. The ribbon is shown to be wound on the spools in a reverse direction as illustrated in FIG. 1.

As seen in FIG. 5, other cartridge configurations may be used, if desired. For example, instead of using projections on the sides of the case as seen in FIG. 1, indented gripping edges 88 and 90 may be used. In the cartridge of FIG. 5, wherein like numerals refer to like parts, wheel 54, for illustrative purposes, is shown as being driven by the printer in a counterclockwise direction, and the ribbon is shown to be dispensed from the generally upper surface of spool 16 and received on spool 18 generally on the upper surface of the spool. With drive occurring as discussed above (wheel 54 engaged by the printer), ribbon 14 would be passing off the generally top side of spool 16, then outwardly toward side 50 and around guide 70, thence outward of drive roller 58 to guide 72, guides 70 and 72 ensuring that the ribbon 14 does not engage or rub on belt 64. Ribbon 14 then passes, as shown by arrow 74, over and between guides 20 and 22. Then it passes over a pair of guides 76 and 78 on the opposite side 51 of cartridge 10, and thence onto spool 18. In any event, applicant's invention is directed to the use of sets of spaced drive wheels, each set having two intermeshing drive wheels mounted in a cartridge using an internally mounted belt for rotating the spools, and the specific configuration of the cartridge is not to be construed as limiting the scope of applicant's invention.

Referring to cartridge 10 in an operating position, where it is horizontal, a significant portion of half (top or bottom) of ribbon 14 is impacted by the print characters of a printer during travel of ribbon 14 between spools 16 and 18. An arm (not shown) from a host computer extends through the openings 68 of case 10, and when the ribbon has been fully wound from one spool and wound on the other, this arm operates a switch in the printer to turn the printer off. This signals the operator to turn the cartridge over such that another drive wheel will engage the drive for the host printer rather than the last used wheel. The result will be that belt 64 and ribbon 14 will reverse their direction, and the opposite half (top or bottom) of ribbon 14 will be utilized by the printer in its travel back through the impact region. Significantly, however, cartridge 10, having an internal belt drive, does not require belt transfer from one side to the other when there is a reversal of operating sides of the cartride as described.

As seen in FIG. 4, wheels 52 and 56 are provided with teeth 60, and wheels 54 and 58 are provided with teeth 62, which are in meshed relation. The configuration of the wheels is identical. The opposite ends 80 and 82 of all four drive wheels are provided with surfaces which mate with the drive shaft of the printers in which the cartridges are used. Surfaces 80 and 82 may be grooved or otherwise configured to permit mating with the drive shafts of the printers.

Of further significance is the fact that belt carrying region 84 of drive rollers 54 and 56 is made cylindrical and is not toothed as in the case of the drive surface of some of the prior art cartridges referred to above. This change is enabled by virtue of the fact that the drive rollers drive a belt which may be under greater tension than the ribbon. This enables a thinner wall thickness for the drive capstan or drive roller and thus a smaller effective diameter. This in turn enables a reduction in rate of drive imparted to the belt and thus to the ribbon. The result is that there is a reduction of approximately 25% in the rate of ribbon travel. Importantly, it has been found that, despite this reduction, the quality of print is not noticably degraded, and thus in effect a user will achieves an approximately 25% reduction in ribbon usage.

By the foregoing, the applicant has provided a significantly improved reversible universal drive ribbon cartridge wherein an outer belt is eliminated. Distinctively, the drive belt is placed internally and requires no disassembly and reassembly. Additionally, an ideal tension is maintained at the print station between gides 20 and 22. Also, by the elimination of the toothed portion of the drive roller where it effects drive, the effective diameter of the drive roller is reduced and thereby a significant increase in usage of ribbon is obtained with the same printer driver.

Finally, by the provision of drive wheels disposed in sets with the drive wheels of each set disposed in meshed relation, and with each set mounted in the cartridge adjacent opposite sides of the cartridge, the cartridge of the present invention may be used in a plurality of printers having drive locations of varying spatial locations as well as direction of rotation. Such drive locations may be from the underside of the cartridge as discussed above, or the drive may be through the top of the cartridge, if desired. Other drive means may also be used to impart rotation to the drive wheels of the cartridge of the present invention. For example, an opening may be provided in sides 48 and/or 50, and the printer drive shaft may be positioned adjacent one of the openings and provided with a gear or other drive means on the end thereof to extend through the opening for engagement with a drive wheel of the cartridge of the present invention.

What is claimed is:

1. A ribbon cartridge for use in a plurality of printers having a drive shaft for operating said ribbon cartridge from different locations, comprising:

a body having a cavity therein;

a pair of ribbon carrying spools rotatably mounted in spaced relation in said cavity;

ribbon exit and entry guides secured to said body, said guides defining a path for passage of ribbon therethrough;

a ribbon carried on said spools and extending therebetween, said ribbon disposed for passing from a first of said pair of spools and out of said body adjacent said exit guide and back into said body adjacent said entry guide for winding on the outer periphery of the second of said pair of spools;

drive means including two spaced sets of drive wheels, each set comprised of two adjacent drive wheels in intermeshing relation, said drive wheels mounted in said cavity, and a predetermined one of said drive wheels disposed for operatively engaging said drive shaft of said printer for rotation thereby, each of said drive wheels including means for being alternately operatively engaged on opposite ends thereof for rotation by the drive shaft of one of said printers; and said drive means further including a belt carried around a drive wheel of each set of drive wheels for rotation thereby and in engaged relation with the outer periphery of said ribbon on said spools for rotation thereof, whereby said first of said pair of spools is rotated by said belt to dispense ribbon therefrom while said ribbon is wound on said second of said pair of spools responsive to rotation thereof by said belt.

2. Apparatus as set forth in claim 1 wherein said adjacent drive wheels of each set are provided with teeth around the periphery thereof for the meshed relation.

3. Apparatus as set forth in claim 2 wherein said belt is carried around an inner drive wheel of each of said sets of drive wheels, said inner drive wheel being the drive wheel of each set of drive wheels which is closer to each ribbon spool.

4. A ribbon cartridge adapted for use in a plurality of printers, each having a drive shaft for operating said ribbon cartridge from different locations, the ribbon cartridge including a body having top and bottom surfaces and spaced ribbon exit and entry arms, said arms defining a path for the passage of ribbon therebetween, a pair of spaced spools housed within the body, a ribbon carried on and extending between said spools and disposed for passing out of said body adjacent the exit arm, past a printing mechanism, and back in said body adjacent the entry arm to the outer periphery of the spool, said cartridge comprising:

drive means including a pair of spaced sets of drive wheels mounted in said body, with the wheels of each set being in intermeshing relation, one of said drive wheels of a set disposed for engagement with the drive shaft of said printer, and a belt mounted around and in operative engagement with a preselected drive wheel of each set of drive wheels, including said wheel in engagement with said drive shaft of said printer, said belt disposed for engagement with a region of said ribbon on said spools for rotation of said spool responsive to rotation of said one of said preselected drive wheels by said drive shaft of said printer, each of said drive wheels having a shaft provided on opposite ends thereof with means for alternately engaging the drive shaft of one of said printers whereby said cartridge can be alterntely operated from both top and bottom surfaces of said cartridge.

* * * * *